US008614632B1

(12) United States Patent
Wells et al.

(10) Patent No.: US 8,614,632 B1
(45) Date of Patent: Dec. 24, 2013

(54) METHOD OF AND APPARATUS FOR CONTROLLING A SOURCE OF LIGHT IN ACCORDANCE IN A SOURCE OF SOUND

(76) Inventors: Kenneth A Wells, Milwaukie, OR (US); Victor W Hatch, Vancouver, WA (US)

( * ) Notice: Subject to any disclaimer, the term of this patent is extended or adjusted under 35 U.S.C. 154(b) by 415 days.

(21) Appl. No.: 12/925,937

(22) Filed: Nov. 2, 2010

(51) Int. Cl.
*G08B 21/00* (2006.01)

(52) U.S. Cl.
USPC ..... 340/661; 340/331; 340/332; 340/815.4; 340/815.6; 84/464 A; 84/464 R

(58) Field of Classification Search
USPC ..... 340/661, 331, 332, 815.4, 815.6; 84/464 A, 464 R
See application file for complete search history.

(56) References Cited

U.S. PATENT DOCUMENTS 4,359,669 A * 11/1982 Anderson ..... 315/208
5,191,319 A * 3/1993 Kiltz ..... 345/73
5,402,702 A * 4/1995 Hata ..... 84/464 R

* cited by examiner

*Primary Examiner* — Tai T Nguyen

(57) ABSTRACT

This device, by its organization and operation, processes sound, usually music. It provides output voltages, for driving lights, which is proportionally representative of input sound levels. Range of sound perception of the human ear exceeds the range of perception of the human eye. It is necessary to adjust the sound level by compression and Automatic Gain Control, particularly by compression, to accommodate the eyes.

A requirement to have the output drive voltage drive the lights is to have a linear response to the compressed audio signal. This requirement is met with an output drive circuit which, has a linear response to the compressed signal. This is achieved with a linear firing circuit when providing output voltage using SCR's or Triacs. In a straightforward variation of the output circuit to improve the power factor, the linear response is maintained by modulating the output with transistors instead of using SCR's or Triacs.

8 Claims, 22 Drawing Sheets

RAMP GENERATOR
PREFERRED FORM

METHOD OF AND APPARATUS FOR CONTROLLING A SOURCE OF LIGHT IN ACCORDANCE IN A SOURCE OF SOUND

DIVISIONAL APPLICATION

We claim the benefit of our prior co-pending provision application Ser. No. 60/846,964 filed Sep. 26, 2006, entitled TIMBRE LIGHTING CONTROLS

BACKGROUND OF THE INVENTION

It is well known to provide an electrical system for producing varying light beams in accordance with music or other audio input. Such systems have converted the music or other audio into electrical signals which are fed into a high frequency filter, an intermediate frequency filer and a low frequency filter. The output of each filter feeds a service such as a light emitting diode or incandescent bulb. See, for example, the following United States patents:

| Patent | Inventor | Date |
|---|---|---|
| 1,977,997 | Wallor | October 1934 |
| 3,228,278 | Wortman | December 1966 |
| 3,720,939 | Polenak | March 1973 |
| 4,771,280 | Molinaro | September 1988 |
| 5,501,131 | Hata | March 1988 |
| 3,815,128 | McClure | April 1974 |
| 3,111,057 | Cramer | October 1959 |

Previous implementations of prior art light control have a very poor response to the audio signal, because of the drastically non-linear designs within the prior art of SCR and Triac firing circuits. This problem causes a very poor response of the output voltage to changes in the audio. U.S. Pat. No. 3,815,128 demonstrates the typical problem of drastic non-linearity of the output voltage response to the audio signal. This is shown by circuit analysis and circuit simulation (SPICE) of the above mentioned patent. The combination of these two problems of compression and non-linear firing circuits produce very poor light response to music.

Another critical feature that the prior art that has overlooked is the importance of the proper use of compression. The lack of proper compression results in brings about a shortcoming of responsive, consistent results. This is typical of the prior art.

SUMMARY OF THE INVENTION

A device that produces an output voltage to drive a light source(s) wherein the AC output voltage(s) to the light source(s) is a linear response of the output voltage to compressed audio signal(s). This linear response to the compressed audio signal(s) is directly proportional to the audio signal with minimum deviation from a linear relationship between the amplitude of the audio and the amplitude of the AC output voltage to drive the source of light.

This directly proportional relationship between the audio and the linear response of the output voltage(s) to drive the lights is accomplished by sensing the audio input electrically from a source which produces sound or, which provides an electrical voltage proportional to the sound level.

This audio signal is amplified and compressed so that the amplitude of the audio signal is reduced to the visual range of the light sense of the human eyes. This compressed signal is then converted to a varying DC audio signal that is proportional to the amplitude of the audio signal.

This DC audio signal is then compared to a time varying reference signal by a comparison circuit; when this audio signal is greater than the reference signal, from the comparison circuit, this comparison circuit outputs a drive pulse to an output drive circuit. This output drive circuit then outputs a pulse of voltage to the source of light.

This ramp voltage is linear to achieve a linear relationship of the output voltage to the DC audio signal amplitude. This achieves a linear relationship between the light intensity and the audio that is experienced by a listener.

An AGC (automatic gain control circuit) in the compression amplifier adjust the audio signal level to keep the audio and lights at comparable levels for the listener/watcher. In addition a noise floor in this amplifier prevents the amplification of low level noise, such as microphone noise, and amplifier/resistor noise from being amplified and providing any output voltage and hence preventing any light production due to any such low level noise.

DETAILED DESCRIPTION OF THE INVENTION

Figure 10:
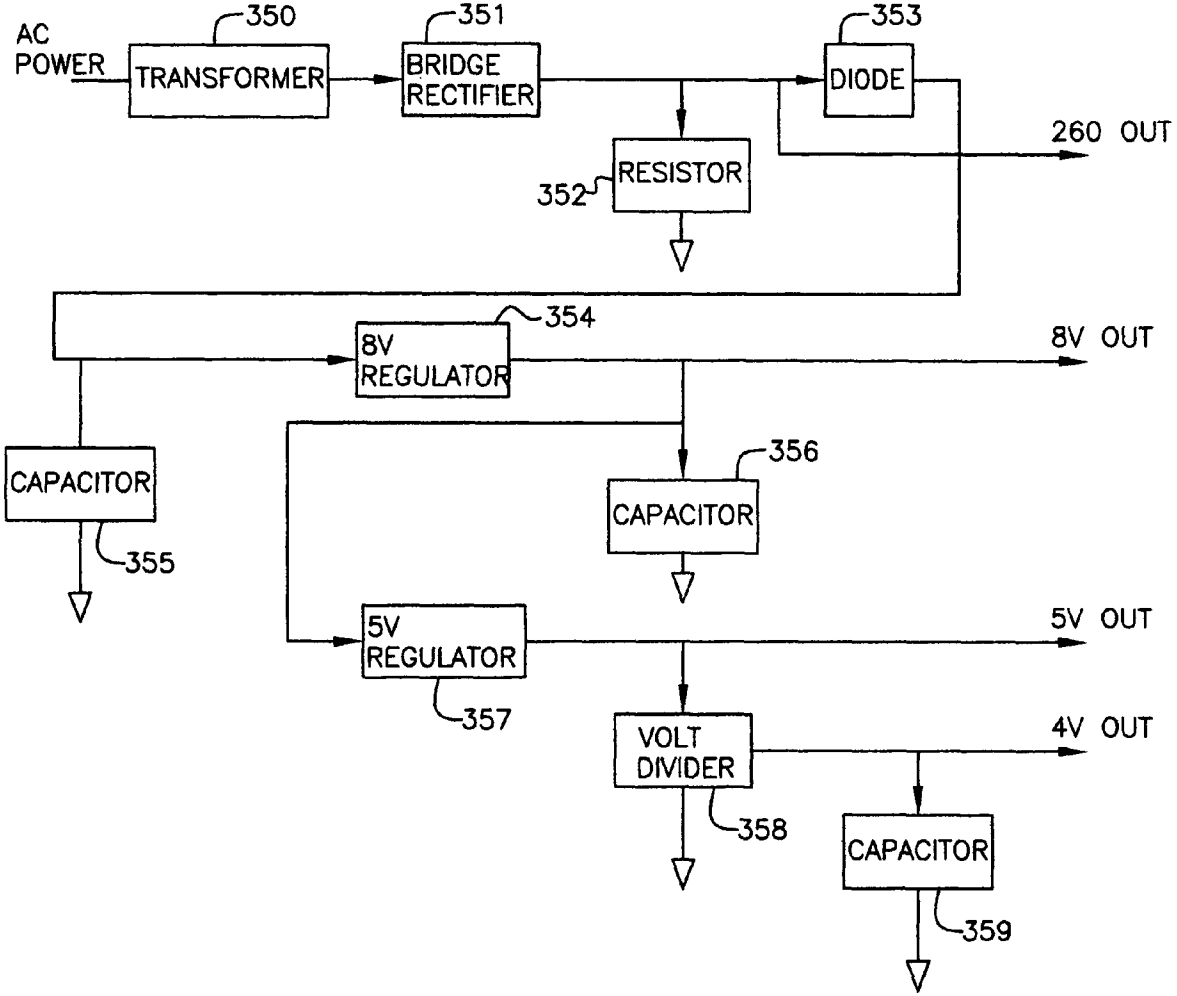
FIG. 10 is a block diagram of the power supply 250 as used in the preferred embodiment.

Item 250 is the power supply for the electronics in the unit (See block diagram, FIG. 10.). It supplies a regulated 8 volts dc, a regulated 5 volts dc and 4 volts dc plus a sync signal 260. The 8 volts dc is the positive voltage for the amplifiers 50, 90, 100, and 110, and the band filters 60, 70, and 80, and the comparators 310, 320, and 330. The regulated 5 volts dc is the supply voltage for the preamp 40. The 4 volts dc is the reference voltage for the amplifiers 50, 90, 100 and 110, and the band filters, 60, 70, and 80. The 4 volts is the zero output level of the amplifiers 50, 90, 100, and 110, and band filters 50, 70, and 120. The sync signal 260 for the ramp generator 180 is developed in the power supply at the zero crossing of the ac line voltage. This power supply differs from the usual by the addition of diode 353 between the bridge rectifier and the filter capacitor 355, and the addition of resistor 352. There is at the junction of bridge rectifier 351, resistor 352 and diode 353 a half wave, unfiltered signal that drops to zero each time the ac line voltage crosses zero. This provides a sync signal to synchronize the ramp generator with the line voltage.

Item 20 is a source of music from an external source. This may be from a microphone or microphones, audio output from a CD player, computer, radio or etc.

Item 30 is a means to select between an external source and the internal microphone. Two input jacks have power provided for two electret type external microphones through two resistors such that these same two jacks provide for input from other sources such the audio output from a CD player, computer or etc. A jack for a high impedance microphone may be provided, this jack has a built in switch that transfers the input from the internal microphone to this input Item 120 may have an internal electret type microphone.

The input signal from item 30 feeds a special integrated circuit amplifier, an Analog Devices (Analog Devices, One Technology Way, P.O. Box 9106, Norwood, Mass. 02062-9106) SSM2165-1 (See FIG. 6A), which has AGC (automatic gain control), compression and a noise floor.

Figure 6:
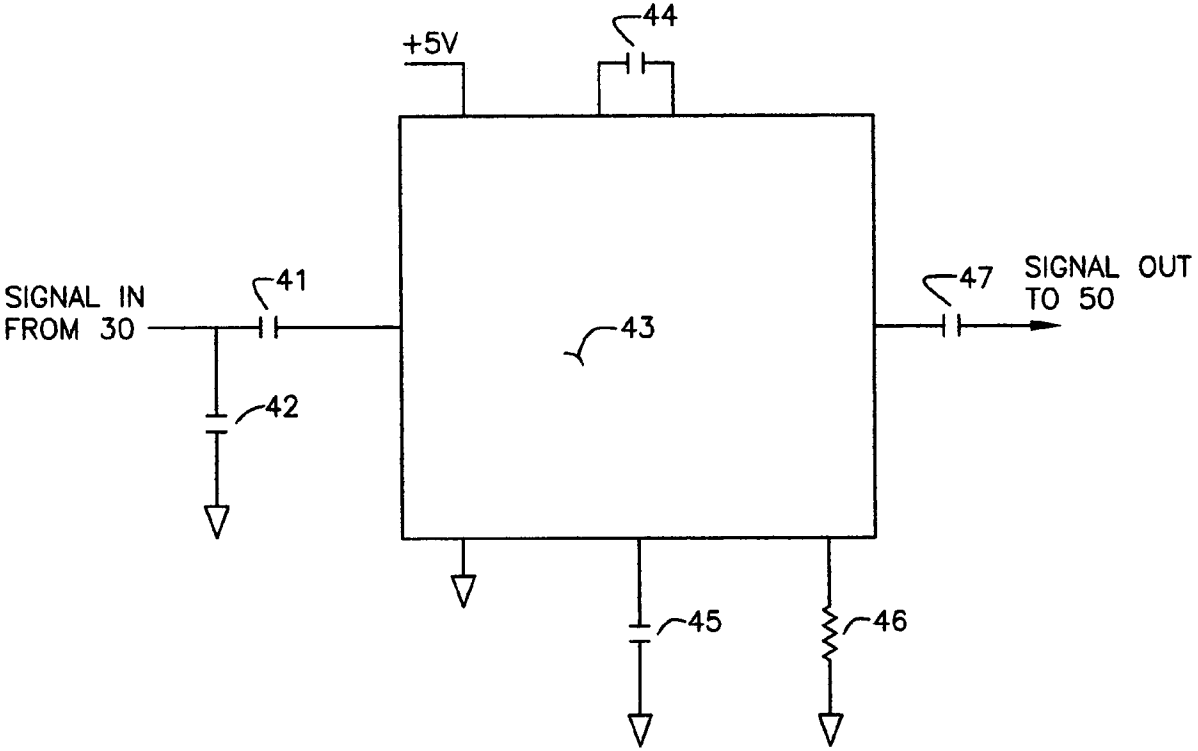
FIG. 6 is a block diagram of item 40.
Figure 6A:
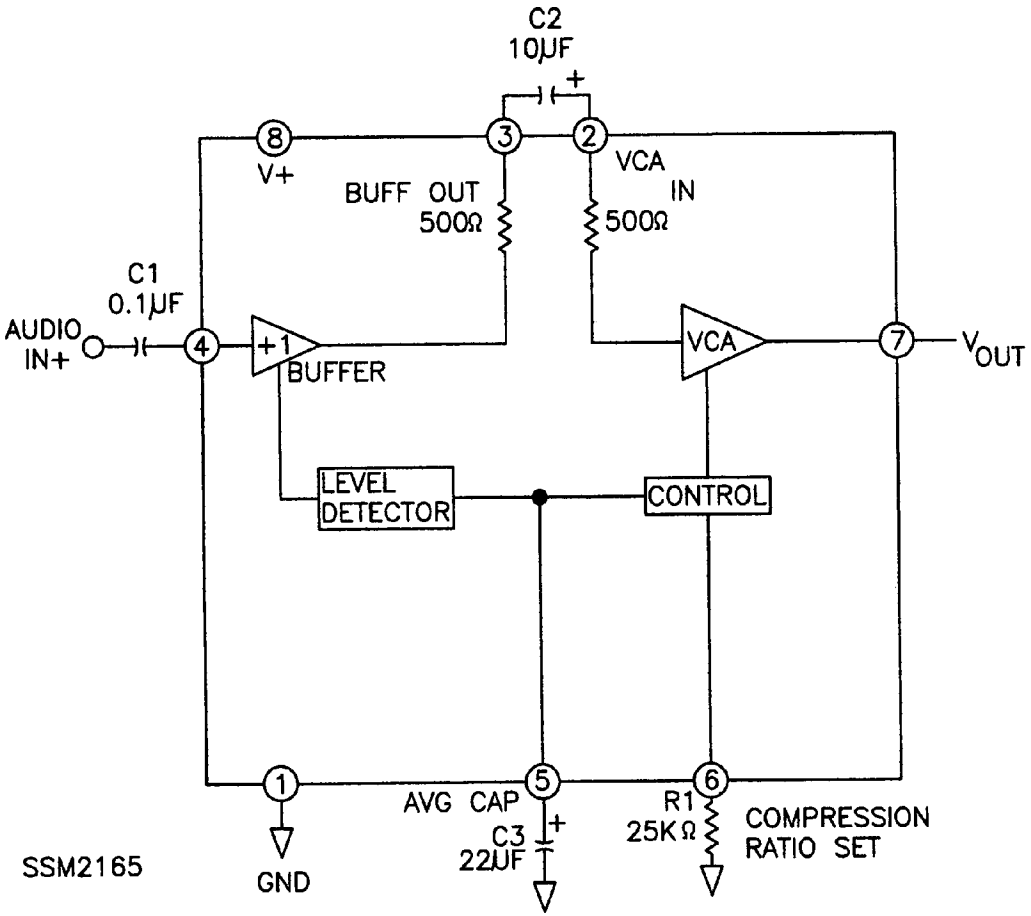
FIG. 6A is a functional block diagram and typical voice application of Analog Devices SSM 2265.

Analog Devices SSM2165-1 Component (See FIG. 6A)

| Type | Value |
|---|---|
| C1 | 0.1 μF |
| C2 | 0.1 μF |
| C3 | 22 μF |
| R1 | 500 ohms |
| R2 | 500 ohms |
| R3 | 25K |

This amplifier has provisions for setting the compression ratio, and the AGC time constant. The compression ratio is set with a resistor at about 5:1, and the AGC time constant is set with a capacitor at about 100 milliseconds. Signals below the noise floor of about 500 micro volts are rejected and not amplified. FIG. 6 is a block diagram of item 40. Capacitor 42 bypasses high frequency noise to ground. Capacitor 41 passes the audio signal to the special amplifier 43 (Analog Devices SM2265-1) while blocking dc., capacitor 44 couples the signals from the input amplifier of amplifier 43 to the VCA (Voltage Controlled Amplifier) section of amplifier 43. Capacitor 45 adjusts the AGC response time of amplifier 43. Resistor 46 adjusts the compression ratio of amplifier 43. For example, such ratio may be approximately 5:1. The output from amplifier 43 is coupled through capacitor 47 to the following amplifier item 50.

The dynamic level of music can vary of a wide range; because of this so therefore there is a clear-cut need for accurately controlled compression. A CD or radio playing music will vary for most songs from about 15 to 20 dB. This is a logarithmic scale; a 15 dB change is a variation of sound intensity of a 32:1 change; a 20 dB change is a change of 100:1. Some music may have an even wider dynamic range such as a live band or orchestra. A 20 dB corresponds to an approximate change from soft, at approximately 60 dB, to loud at approximately 120 dB. Very loud would be approximately 100 dB.

A 15 dB change picked up by a microphone would produce a variation in the voltage from the microphone of 32 times; for example a change from 0.63 volts to 2 volts; if this were amplified 2.5 times the signal would be 0.158 volts to 5 volts.

This 32 times variation can not be well reproduced by the intensity of the light. A desirable variation in the lights that would be pleasing would be about 8:1 to 10:1. This would give a variation from dim to bright that would be acceptable. If an 8:1 variation were desirable for a 20 dB change in the music then a compression ratio of 32 divided by 8 would give a needed compression of 4. A compression ration of approximately 5:1 was selected for the preferred form because it gives a pleasing response to music; for a 20 dB change in music this gives a variation in light intensity of about 6:1.

The preferred form makes use of an integrated circuit amplifier from Analog Devices SSM2165 that was designed for use in data transmission system and for intercoms that provides both compression and AGC operation. The compression ratio in the preferred form, is set to approximately 5:1; thus, a change of 10 dB (a ten times variation in the sound level) results in a signal voltage change of 2:1 instead to a 10:1 change—thus the light power output will vary by 2:1 instead of on and off.

With the lack of compression there would be produced an on-off blinking of the lights in response to the variation in loudness of the music. Use of AGC (automatic gain control) is used to adjust the signal within range for slow changes; such as a change from a loud passage to a soft passage, but this can not compensate for faster changes in the volume of tones (The AGC time must be set slower than the lowest tone frequency, usually 2 to 5 times the time for the lowest tone—for music which has base tones down to 20 Hz, this would require the AGC response be no faster than 100 milliseconds to 250 milliseconds.) The combination of the having a linear output drive, and compression set at about 5:1 gives a very good response of the lights to music being played; such that subtle variations in the volume of music such as vibrato which shows up in the response of the lights.

The input to amplifier 50 is from the output pre-amp 40. The gain control of this amplifier 50 is available on the front panel as an operator control; this controls the signal level to the following active filters 60, 70 and 80. This gain control sets the overall brightness of the lights connected to the outputs of item 220

A three band active filter 60, 70, and 80, separates the audio signal into three channels, a low frequency signal channel, a mid frequency signal channel, and a high frequency channel. This filter is comprised of integrated circuit amplifiers connected to form a three band active filter. The outputs of the filters 60, 70 & 80 are passed to amplifiers 90, 100 and 110, respectively.

Item 90, 100, and 110 are amplifiers, one for each band. The high band amplifier 90 and the low band amplifier 110 have operator controls to set the gain of these amplifiers. Amplifier 100, the midrange amplifier, has fixed gain. The gain of the midrange is set by the adjustment of the gain of amplifier 50, the brightness control. The relative brightness of the high and low bands in relation to the midrange band is set by the gain controls of the high band amplifier 90, and low band amplifier 110.

Figure 1:
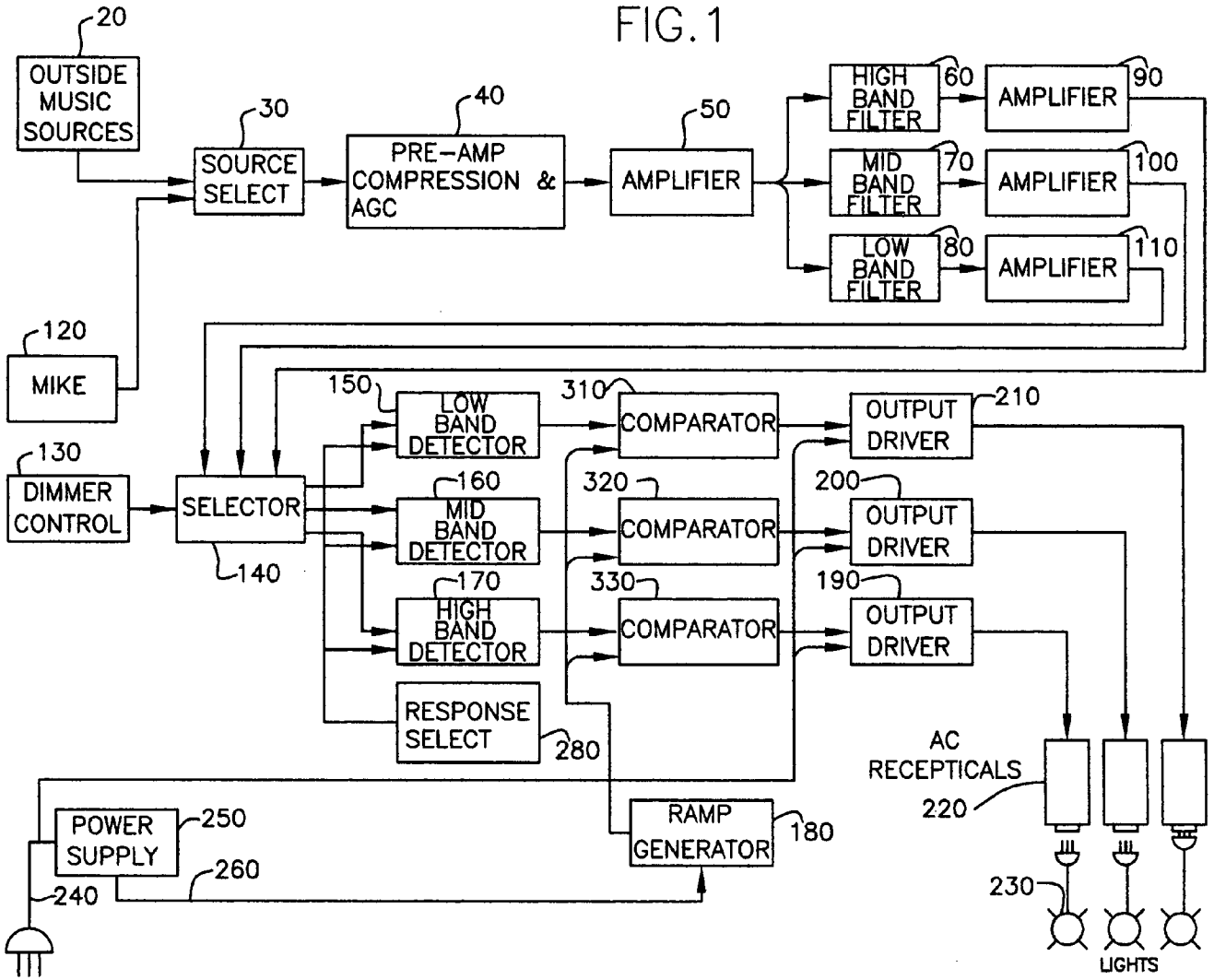
FIG. 1 is a block diagram of the preferred form of the invention.

Item 130, FIG. 1 is a potentiometer arranged to provide a dc voltage in lieu of the output of the amplifiers 90, 100 and 110. This provides a means of switching the operation of the lighting controls from the response to music to a constant light level set by the dimmer control item 130.

Item 140 is a means of switching from response to music to dimmer control of all three channels from either dimmer control or response to the audio signal. This is selected by the operator with a switch. Item 140 switches the input to the detectors from amplifiers 90, 100, and 110 to the output of the dimmer control 130.

Figure 2:
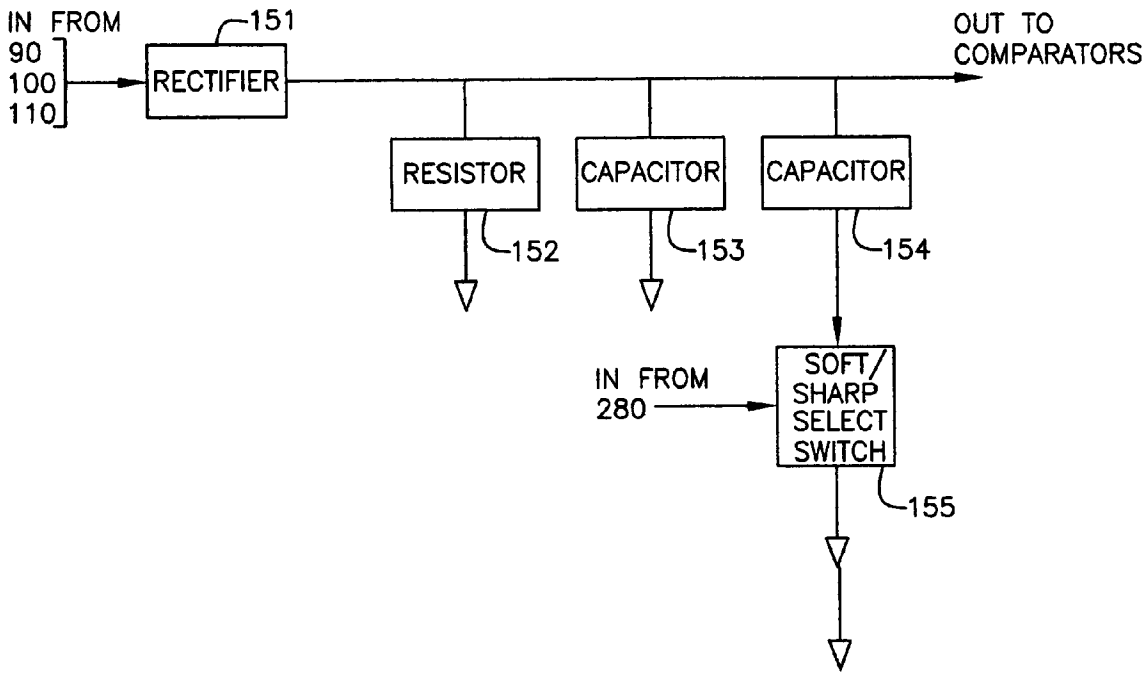
FIG. 2 is a block diagram of the detector circuit 150 for the preferred form of the invention.

Item 150, 160 & 170 are detectors that convert the audio signals to pulsating dc voltages (see FIG. 2). This consists of a diode 151, resistor 152, and capacitor 153 circuit except for the high band 170 which uses a transistor as item 151 instead of a diode to reduce the charge time of the capacitors at the higher frequencies. Resistor 152 provides for the discharge of the capacitor in the detector circuit. These detectors 150, 160, and 170 detect and convert only the positive going portion of the audio signals to give only one half wave detection (½ wave rectification.). There is provision, with soft select switch 155 for switching in added capacitor 154 to increase the discharge time of the detector. Adding in this capacitance gives the lights being driven a "softer" appearance in response to music. This soft select switch 155 is a FET (Field Effect Transistor) which is turned on to add in the capacitor in response to the select signal from item 280. This softer appearance of the lights is due to this added capacitance slowing the response of the lights to the changes in the amplitude of the audio signal. For use with LED's it is desirable to have a slower or longer response than when used with incandescent lights; this is because incandescent lights have a heating and cooling time when they change intensity whereas led lights do not have this heating and cooling time but have an instant response to changes.

Item 280 is an operator controlled switch to select the sharp or soft response of the lamps connected to outputs 220, by switching in the added capacitance in the detectors 150, 160, and 170.

Figure 12:
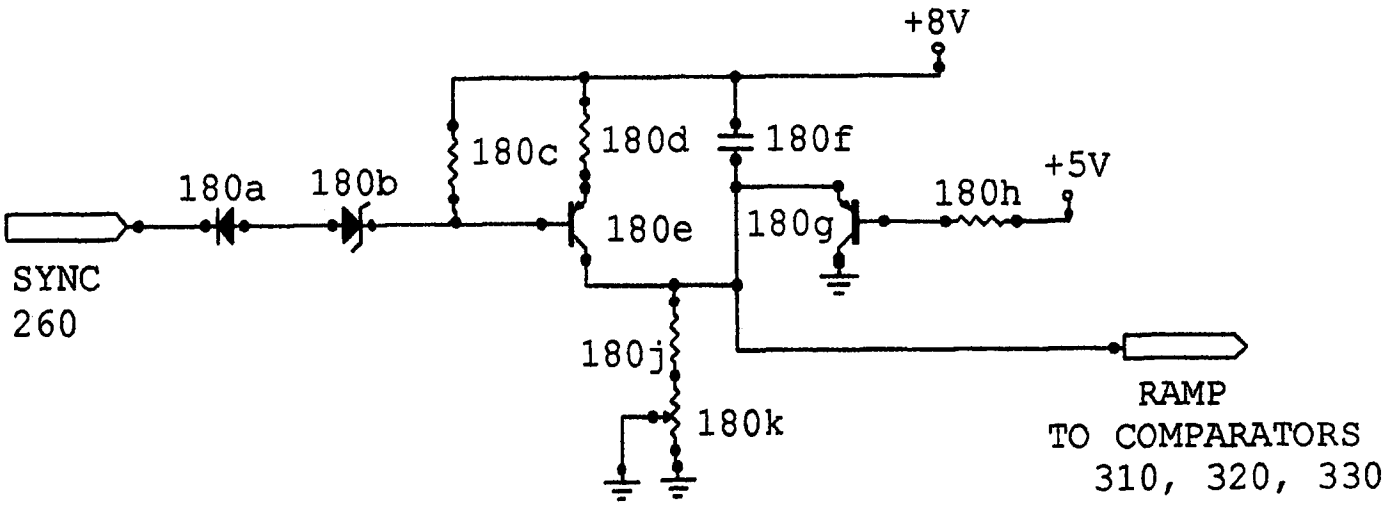
FIG. 12 is a detailed schematic of the ramp generator as used in the preferred embodiment.
Figure 12A:
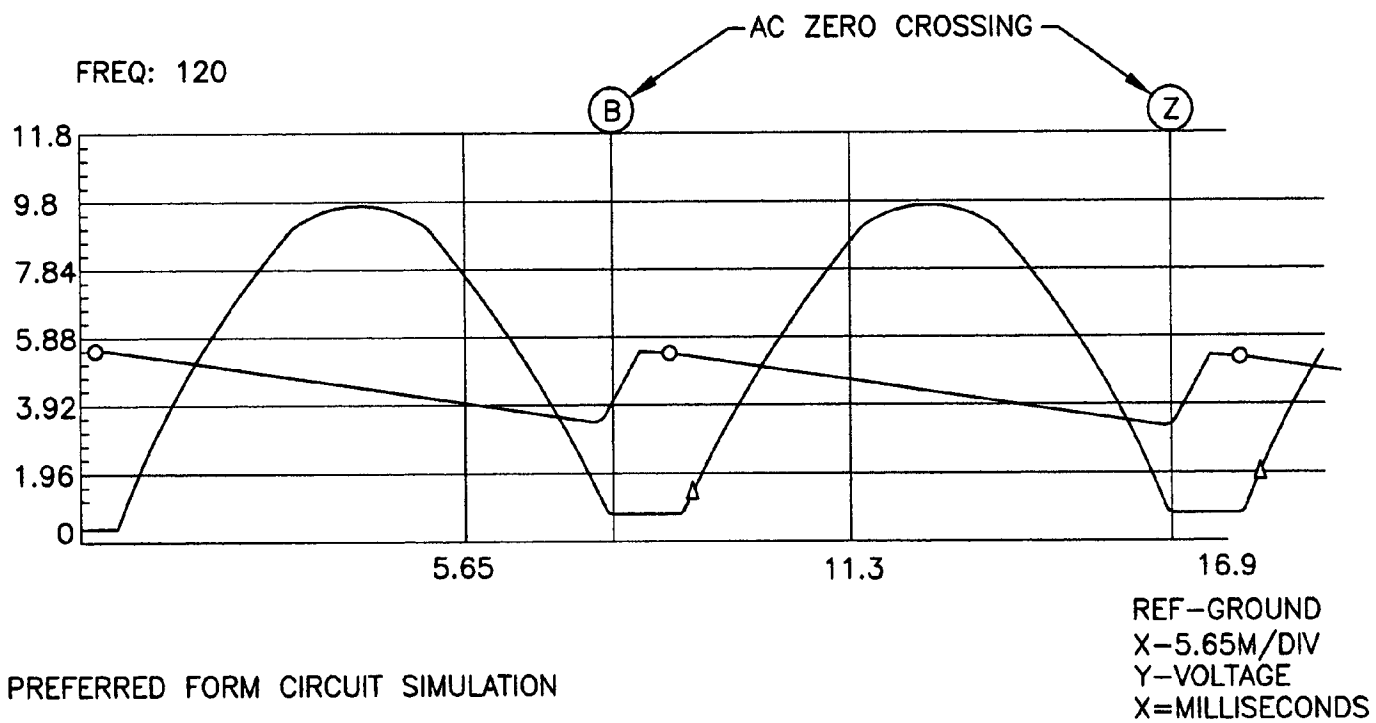
FIG. 12A is a graph of the ramp generator wave forms.

Items 180, 190, 200, 210, 310, 320, and 330 comprise three linear firing circuits, that is, these circuits provide an approximately linear change in the output voltage versus the change in voltage from the detector circuits 150, 160, and 170. It is desirable to use a linear firing circuit so that the brightness of the lights will vary in directly in proportion to the variation of the compressed audio signal; this presents a good visual response of the lights to the changes in loudness of the music in each band. This also results in the lights 230 shown a response to changes in music volume such as vibrato to give a very pleasing response. Item 180 (See FIGS. 12 & 12A) produces a near linear ramp with its high point at the end of the zero crossing of the AC line voltage and decays to its low point at an approximately linear rate at the start of the next zero crossing of the ac line voltage. Transistor 180*e* is turned on through diode 180*a* and zener diode 180*b* when the voltage of the sync signal 260 from the power supply 250 drops low at each ac line zero crossing. When transistor 180*e* is turned on the voltage at the junction of transistor 180*e* collector, capacitor 180*f*, transistor 160*g* emitter, and resistor 180*j* is pulled upward reducing the voltage across capacitor 180*f* by discharging it through resistor 180*d*. This is the high point of the ramp. This high voltage point of the ramp is clamped by transistor 180*g* to approximately 5.7 volts. Resistor 180*h* limits the base current through transistor 180*g* while it is clamping the ramp voltage. At the end of the zero crossing sync signal 260 from the power supply, transistor 180*e* is turned off and the capacitor 180*f* discharges through resistor 180*j* and potentiometer 180*k* until the next zero crossing sync signal 260 occurs. Resistor 180*c* provides a quick discharge path of the junction capacitance of diode 180*a*, zener diode 180*b*, and the emitter base of 180*e* so that transistor 180*e* is quickly turned off at the end of each zero crossing sync signal 260. Potentiometer 180*k* is for adjustment of the low point of the ramp voltage at the end of each one half cycle of the ac line voltage, this low point occurs at the start of the next sync signal 260. This low voltage point of the ramp signal is set just above the zero voltage output (no audio signal) of the detectors 150, 160, and 170 by potentiometer 180*k* at approximately 3.7 volts. The adjustment of potentiometer 180*k* is set during manufacturing test. This ramp voltage from the ramp generator 180 is the reference voltage for comparators 310, 320, and 330. Since the zero output voltage of the amplifiers 90, 100, and 100 is 4.0 volts dc (Set at ½ the 8 volts dc supply voltage from the power supply 250.) then the zero output voltage from the detectors 150, 160, and 170 is approximately one diode voltage drop lower, and the zero output voltage of detectors 150, 160, and 170 will be approximately 3.5 volts dc. So the low voltage point of the ramp is just above the zero voltage output of the detectors 150, 160, and 170.

Figure 12B:
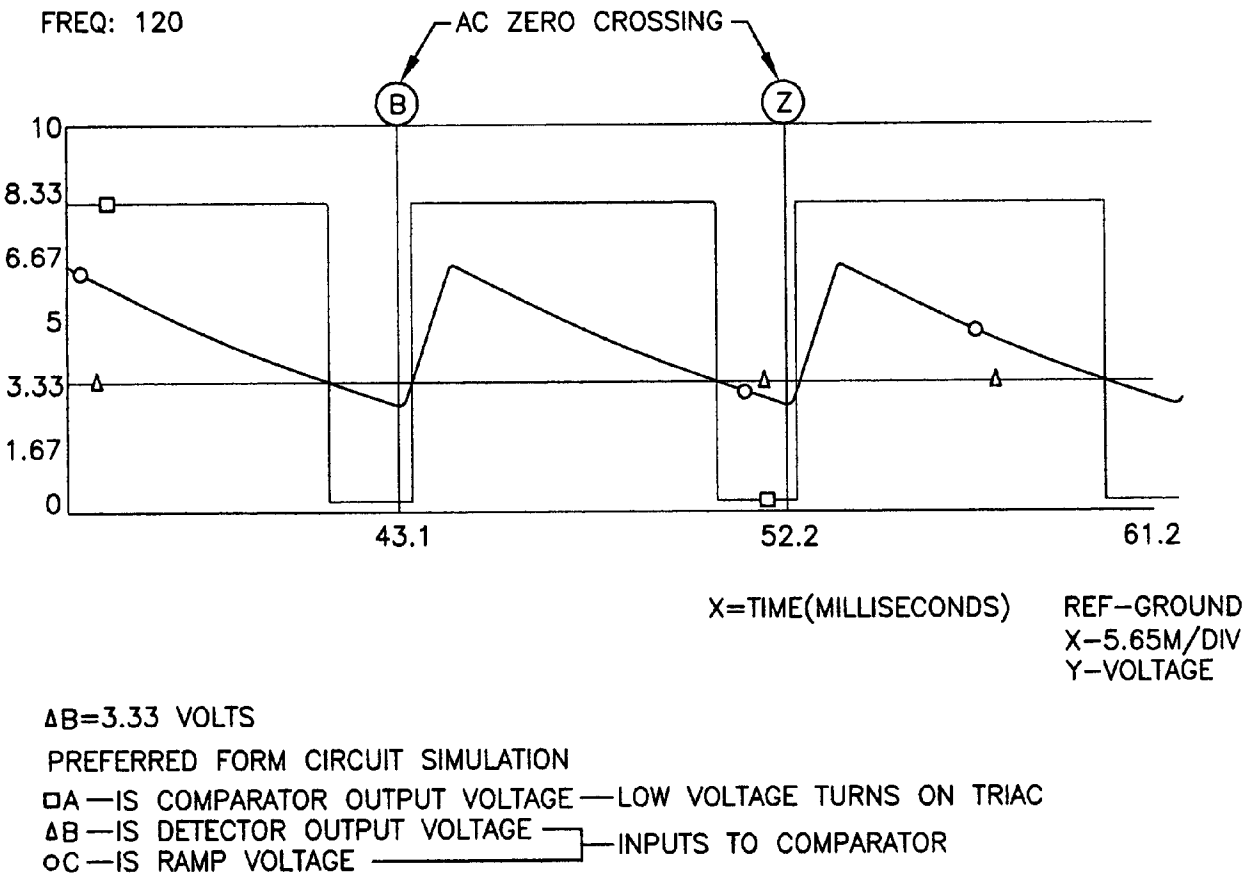
FIG. 12B is a block diagram of the preferred form showing the inputs to and output from the comparator.
Figure 12C:
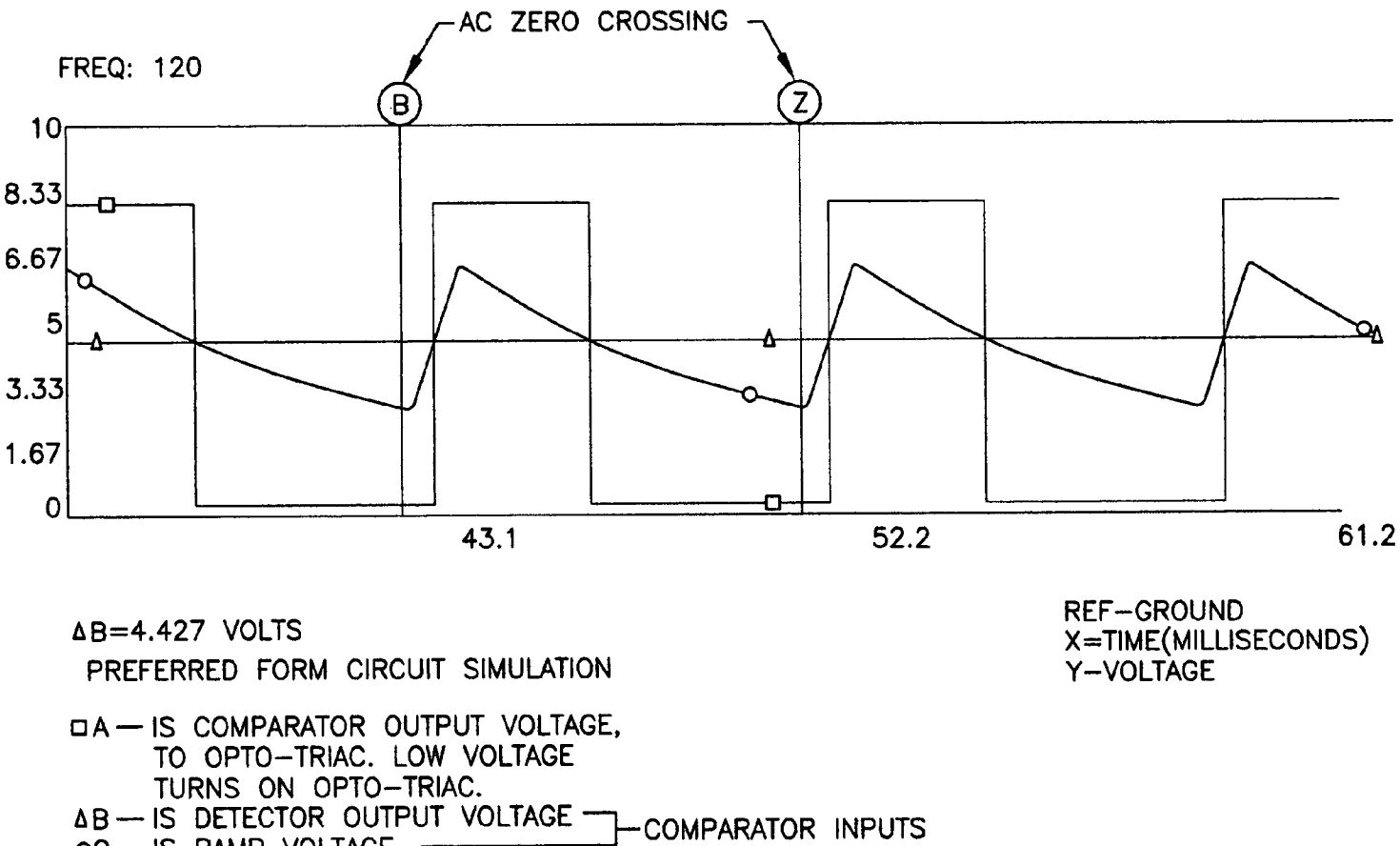
FIG. 12C is the same as 12A, but at a different voltage.

Items 190, 200 and 210 are output drivers. They have optically coupled triacs which drive power triacs to provide the switching of ac power to the output receptacles 220 to power the lights 230 that are plugged into the output receptacles. The output receptacles are standard ac receptacles into which lights, strings of lights, such as "Christmas lights", strings of LED's (Also "Christmas" lights.) may be plugged in. Any lights that operate at 120 volt ac except fluorescent lights or light fixtures with dimmer controls may be used. The comparators 310, 320, and 330 compare the signal from the detectors 150,160, and 170 to the ramp signal (FIGS. 12B & 12C). Consider detector 150 and comparator 310: When there is no audio signal into detector 150 from amplifier 90 the voltage on the output of detector 150 will be at about 3.5 volts; when this is compared to the ramp at the inputs of comparator 310, there will be no switching of the output of the comparator 310 to the output driver 210, and thus no output voltage. As the audio input to the detector 150 from amplifier 90 increases enough to produce 3.8 volts (as an example.) then comparator 310 output will switch when the ramp voltage drops just below the 3.8 volts to produce an output signal to the output drive 210 shortly before the zero crossing. This will switch the output drive 210 on late in the cycle so that the conduction period of the triac in output drive 210 is short, producing only a low voltage output to the light connected to the output. This switching of comparator 310 will occur when the audio signal from detector 150 exceeds the ramp voltage from ramp generator 180. When the audio signal is further increased, the output of the comparator 310 will occur earlier in the ac cycle turning on the triac in output drive 210 earlier in the ac cycle and thus producing more output voltage to the light that is connected to the corresponding receptacle in 220. The earlier in the half cycle that the triac in output drive 210 occurs the higher the output voltage will be. Thus there is a near linear relationship between the amplitude of the audio signal from the detector and the output voltage and thus the intensity of the light or lights connected to the output receptacles. With a resistive load the power in the load is; P=V^2/R, where P is the power, V is the voltage, and R is the resistance, and V^2 is the voltage squared. This would seem to indicate the brightness of an incandescent lamp would vary as a function of the voltage squared; however this is not true. The power and brightness of an incandescent lamp is proportional to the voltage; this is true because the resistance of an incandescent light bulb increases with power, from a low value when cold to a much high resistance when hot. Thus there is a near linear variation of voltage from output driver 210 proportional to the amplitude of the audio or music signal and thus there is a near linear variation of brightness of the light to audio signal strength. The voltage from the output drivers 190, 200, and 210 are connected to the output receptacles 220. LED's have a linear resistance, that varies with the current through them voltage so they will similarly vary in brightness with voltage Incandescent lights or strings of lights or LED strings designed for operation from 115 or 120 volts ac may be plugged into these output receptacles. Any incandescent or LED light designed to be plugged into the standard ac power outlets may be used, only limited by the power rating that must be within the power rating of the lighting control. This light control can be scaled for low or high power and can be scaled for other line voltages and frequencies as may be used in other countries.

Embodiment 2

Embodiment 2 differs from the preferred form in the following items:

Item 250 is the power supply and is changed in Embodiment 2 to provide a regulated plus 5 volts, a regulated negative 5 volts and the sync pulse for the ramp generator item 180.

Figure 7:
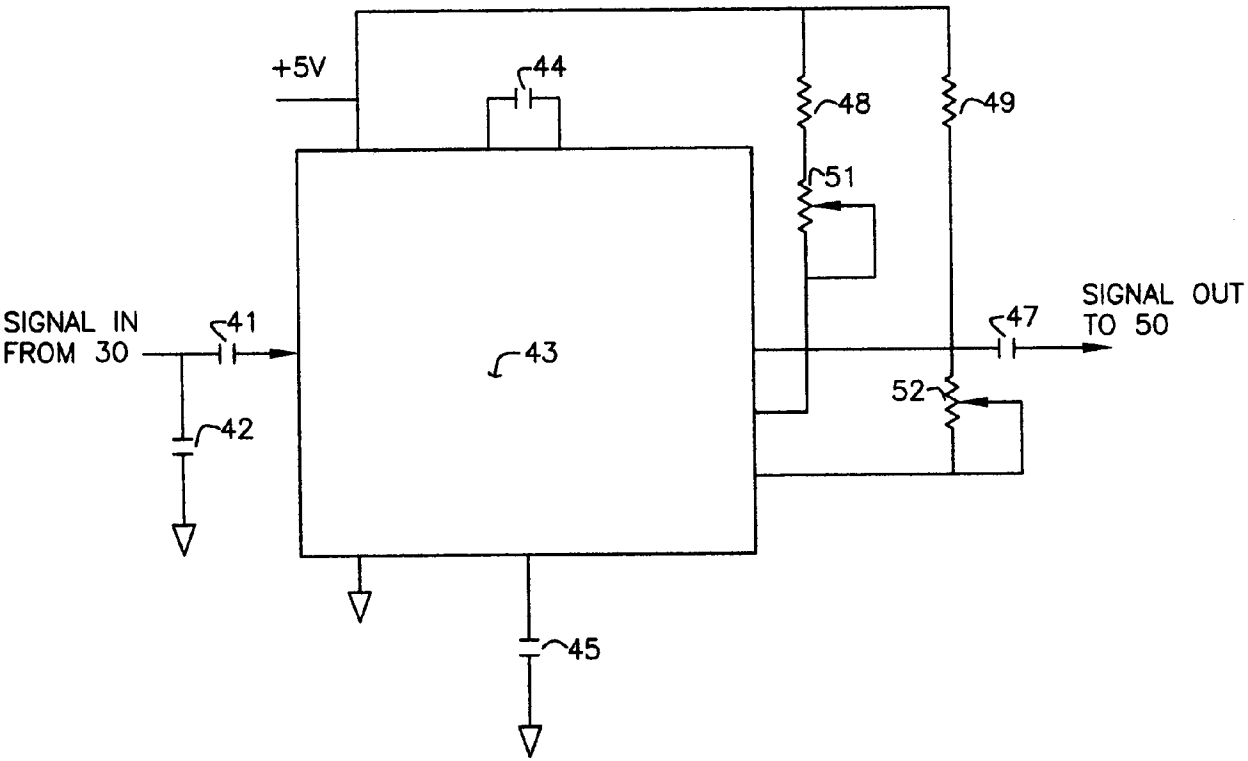
FIG. 7 is a block diagram of item 40 as changed for embodiment 2

Item 43, an amplifier (See FIG. 7), is changed from Analog Devices SSM2165-1 to Analog Devices SSM2167-1. Resistor 48 and potentiometer 51 provide a means for the operator to adjust the noise floor, which sets the level at which the background is rejected. Resistor 49 and potentiometer 52 provide a means for the operator to adjust the compression ratio and thus the response of the lights connected to the outputs to the lights to be adjusted for the most pleasing response to the music.

Items 60, 70 and 120 (See FIG. 5) are three band filters. These filters are changed from a three band filter using operational amplifiers to three switched capacitor filters. The band filters in this embodiment are set with a much sharper cutoff between bands. This means there is almost no overlaps of bands. The switched capacitor filters used are integrated circuit switched capacitor filters, Linear Technology LTC1068. The filter characteristics of the switched capacitor filters using the LTC1068 are set by resistors and by the clock frequency. The cutoff at the edge of the bands is set to be much sharper, with much less overlap between bands than in the preferred form.

The clock item 271, a Linear Technology (1630 McCarthy Blvd. Milpitas, Calif. 95035-7417) LTC1799) (these are added into Embodiment 2 see FIG. 5), and provides the clock frequency directly for the high band switched capacitor filter 60. The clock frequency is divided in half by the divider 272 to provide the clock frequency for the midrange switched capacitor filter 70. The frequency from divider 272 is again divided in half by divider 273 to provide the clock frequency for low band switched capacitor filter 120. The frequency of the clock 271 is adjustable by the operator over a 4 to 1 range. When the nominal clock frequency is reduced by one half all three filters 60, 70 and 120 are lowered in range by one octave. When the nominal clock frequency is doubled all three of the filters are raised in range by one octave. This provides a means for the operator to change the response of the lights to music to suit instruments or vocalists, as for example if a piccolo is being played or a soprano is singing it would probably be desirable to raise the response of the filters and thus the lights, or if a bassoon or bass were being played it would probably be desirable to lower the response of the filters and thus the lights to give a more pleasing response of the lights.

Figure 3:
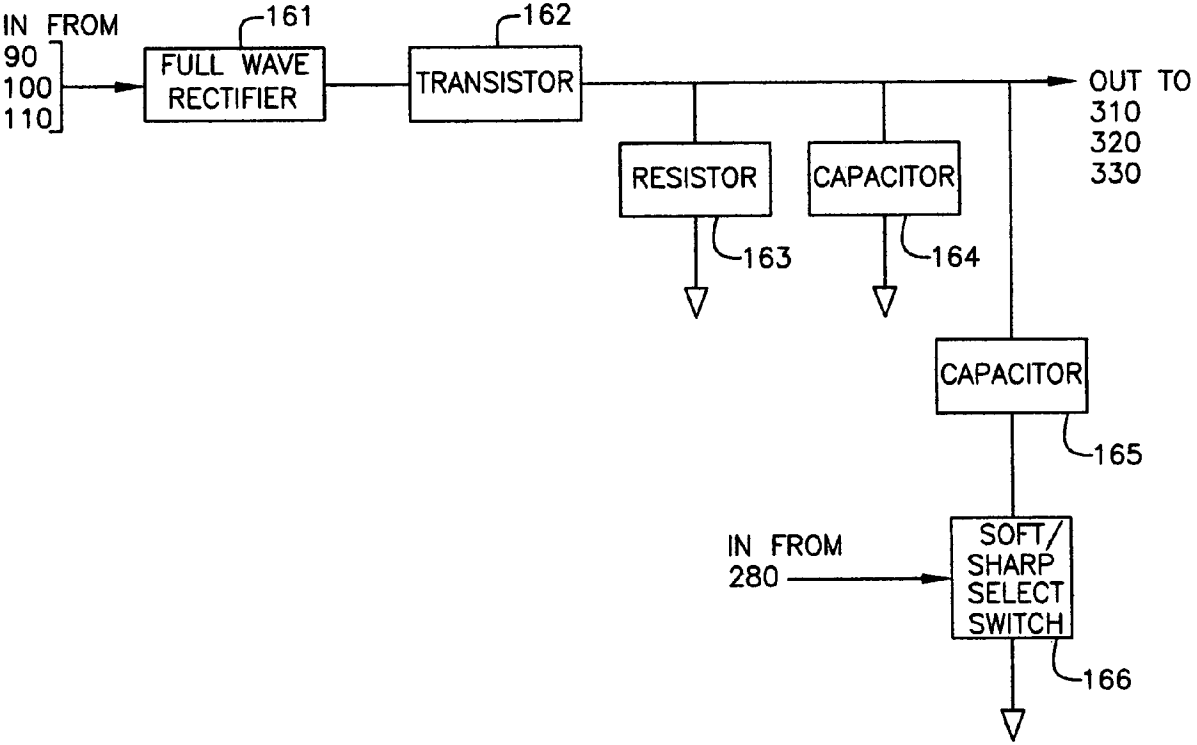
FIG. 3 is a block diagram of the detector circuit 150 for embodiment 2 of the invention.

The detectors (See FIG. 3 Embodiment 2) differ from those in the preferred form. Instead of a simple diode or transistor ½ wave detector as is used in the preferred form a full wave operation amplifier detector is used, item 161. This is followed by a transistor 162, to avoid loading the detector, which charges capacitor 164. Resistor 163 provides the discharge of capacitor 164. For soft response capacitor 165 is added to increase the discharge time for the detector circuit. This capacitor 165 is switched in by soft select switch 166 which is a FET transistor, which is turned on by a signal from item 280 response select. It is also possible to use a different clock for each band and thus be able to independently move the bands in frequency.

Embodiment 3

Item 120, the internal microphone is not included in Embodiment 3.

Item 30 is changed in embodiment 3 by adding provisions for line input, speaker input, low impedance microphone, or high impedance microphone. There are provisions for the microphone inputs to be fed through; the microphone input connector is directly connected to an output connector. The microphone may be plugged into the unit and be directly connected to an output which can feed an audio amplifier while the signal is tapped off to feed into the inputs of the lighting control. Similarly the speaker right and left signals can be fed in and the out to speakers while the signal is tapped off for an input to the lighting control.

Figure 8:
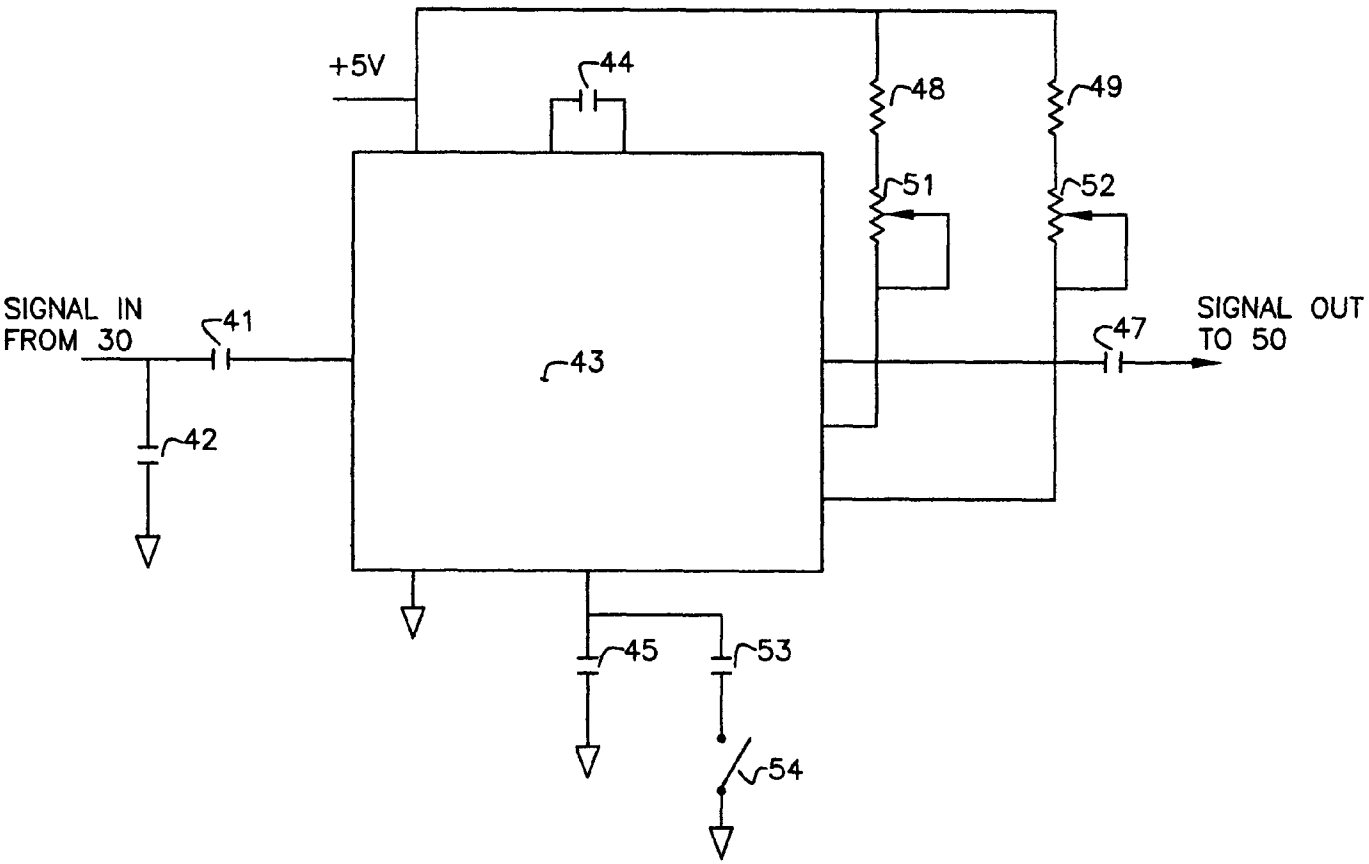
FIG. 8 is a block diagram of item 40 as changed for embodiment 3.

Item 40 in Embodiment 3 (See FIG. 8), as in Embodiment 2, make use of the special amplifier from Analog Devices, SSM2167. As in Embodiment 2, there is a provision for operator adjustment of the noise floor, the level below which background noise will be rejected. As in Embodiment 2 there is provision for operator adjustment of the compression ratio. A selector switch is added for the setting of the response time of the AGC (automatic gain control). The preferred form of the present invention makes use of an integrated circuit amplifier that provides both compression and AGC operation. This can also be achieved by use of other components but, the choice of this integrated circuit amplifier simplifies the design. For some of the present invention embodiments the compression ratio is adjustable by the operator to suit their music or other applications. A compression ration of approximately 5:1 was selected for the present invention because it gives a pleasing response to music; for a 20 dB change in music this gives a variation in light intensity of about 6:1.

Figure 9:
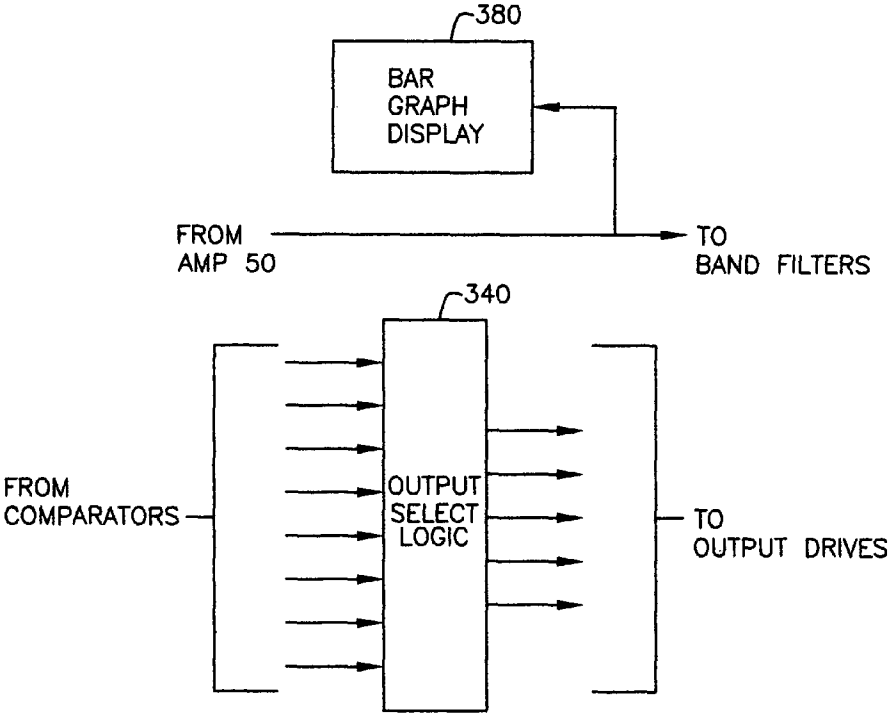
FIG. 9 is a block diagram of added items for embodiment 3.

Item 380 is a bar graft indicator (See FIG. 9). Embodiment 3 has a bar graph indicator added to display the signal level from amplifier 50 to aid the operator in set up.

Figure 5:
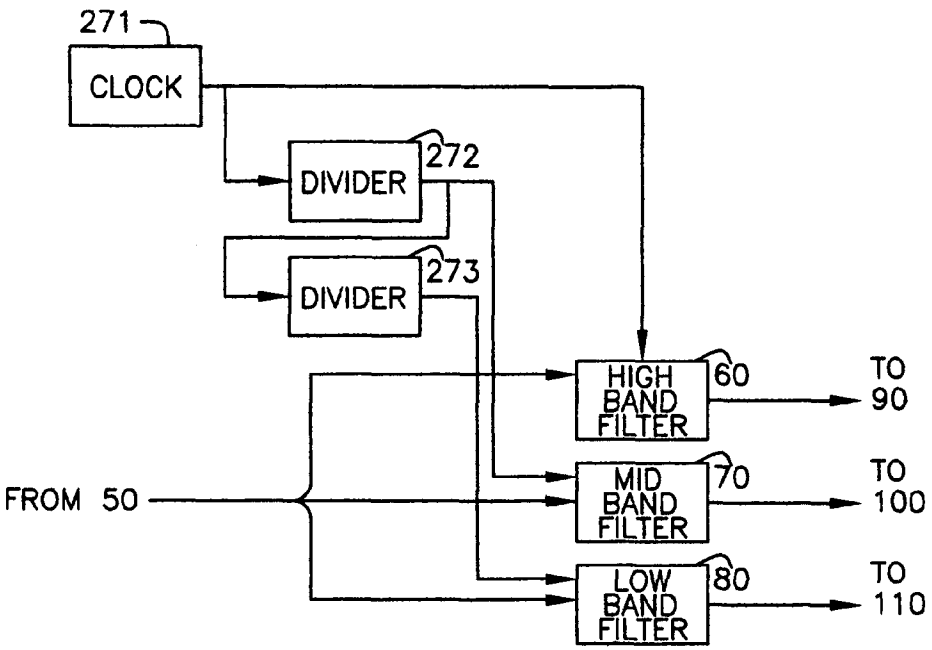
FIG. 5 is a block diagram of the revised band filters 60, 70, and 80, which used operational amplifiers to comprise active filters to switched capacitor filters for embodiment 2. This diagram shows the use of a clock to set the frequency of the filters.

Items 60, 70, 80 See FIG. 5). Instead of 3 band filters as used in the Preferred Form and in Embodiment 2, Embodiment 3 uses 7 switched capacitor filters. Each frequency band is narrower than in the Preferred Form or Embodiment 2. To accommodate these added filter bands a third divider is added to provide the clock frequencies needed. As in Embodiment 2 there is provision for operator adjustment of the clock frequency so that the bands filters can be moved up or down by an octave; by reducing the clock frequency by one half or by doubling the clock frequency. It is possible to have more than one clock, with each controlling different bands.

Figure 4:
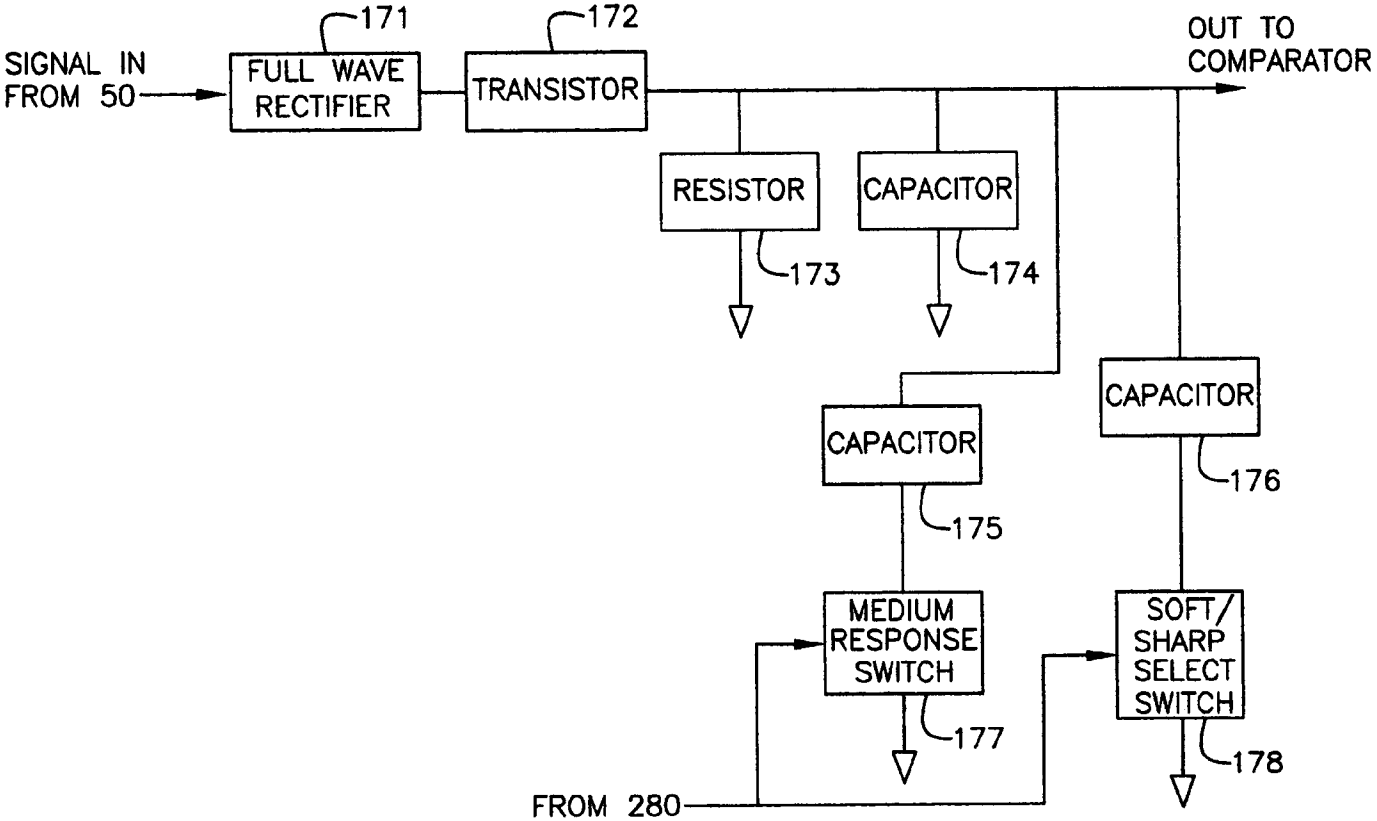
FIG. 4 is a block diagram of the detector circuit 150 for embodiment 3 of the invention.

Items 150, 160, 170 are detectors (See FIG. 4). There are seven detector circuits in Embodiment 3, one for each of the frequency bands. The detector circuits as in Embodiment 2 make use of operational amplifiers to produce full wave detection, item 171, of the audio signals; thus producing better response time to the audio signals. Provisions in Embodiment 3 are provided for soft, medium or sharp response. For medium response capacitor 175 is added by switch 177 in response to a signal from item 280. For soft response capacitor 176 is added in by soft response switch 178. For sharp response capacitors 175 and 176 are not connected into the circuit. The response time is selected by an operator selector.

Items 310, 320, and 330 are comparator (See FIG. 1). There are seven comparators in Embodiment 3.

Item 340(See FIG. 9) is added in Embodiment 3. Item 340 is made up of switches and logic gates to provide selection of any or the seven frequency bands or the dimmer control to any of the 5 output drives.

Items 190, 200 and 210 are output drivers. Instead of three output drives as in the Preferred Form and in Embodiment 2 there are five output drivers in Embodiment 3. Each output driver is rated to 500 watts output and 1500 watts total power output. This power could be scaled to any power level.

Item 220 is an a.c. receptacle. Instead of 3 single ac outlet receptacles as in the Preferred Embodiment and Embodiment 2 there are 5 duplex ac outlets in Embodiment 3. This provides 10 ac outlets, 2 per output. The reference to 3 receptacles is only for reference and in no way limits the present invention in the number of receptacles used.

Embodiment 4

Figure 10A:
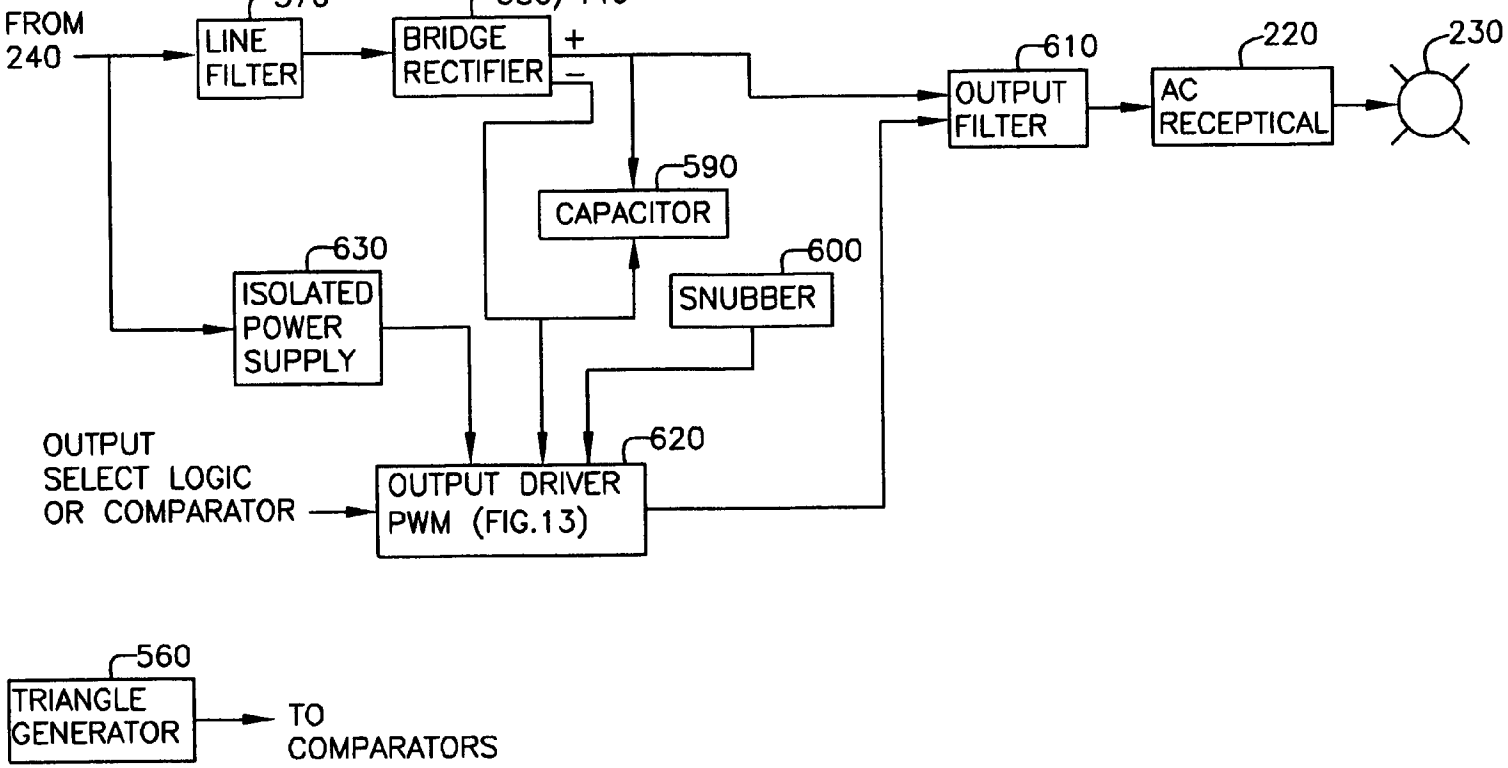
FIG. 10A is a block diagram of embodiment 4

Embodiment 4(See FIG. 10A) makes use of transistorized outputs, with pulse width modulation to provide a near unity input power factor instead of using triacs with phase control. Triacs and SCR's, depending on the degree to which they are phased on, have poor input power factor. When used as in the Preferred Form, and Embodiments 2 and 3 the input power factor will vary with the brightness of the lights, items 230, connected to the outlets, items 190, 200, and 210. For higher powers it becomes more important to have a near unity power factor. Pulse width modulation also provides a near linear power output response to the audio signal.

Item 250, the power supply for the control circuits provides a regulated positive 5 volts and a regulated minus 5 volts as in Embodiments 2 and 3, but it does not provide a sync signal as in the prior embodiments.

Item 180, the ramp generator is not used in Embodiment 4.

Item 560 is a triangular wave generator, that provides a triangular output at the desired switching frequency of the output drivers, items 620, and etc. (any number of outputs and output drivers could be provided.) This triangular wave provides the reference signal for the comparators. A saw-tooth wave could also be used instead of a triangular wave. The frequency of the triangular wave sets the output switching frequency. The switching frequency should be above the audio range that is above 20 KHz. 50 KHz is chosen as the switching frequency for Embodiment 4. The higher the switching frequency the smaller the components in the output filters, item 610, can be; conversely the switching losses of the transistors, item 483, and the snubbers, item 600, will be. Two phase or three or more phase waveforms from item 560 with each applied to a different comparator provides a means of operating some of the output drivers items 620 can be made which would reduce the ripple current through the capacitor 623.

Item 570 is an ac line filter. The purpose of this filter is to prevent transient voltages due to the switching of the output drive 620 from being fed back onto the ac power line. This is an LC (Inductor-Capacitor) filter. This filter is a commercially available item.

Item 440 is a bridge rectifier which converts the line voltage to a dc voltage.

Item 590 is a capacitor that provides a bypass for the switching currents between the plus and minus dc voltage output of item 580.

Item 600 is a snubber circuit to reduce the switching transient voltages across the power transistor, item 623. This snubber circuit is capacitor and resistor in series. It prevents the transient voltages caused by switching from becoming excessive and causing a failure of the transistor item 623.

Item 610 is a filter for the output power to the output receptacles. This is an inductor-capacitor filter. This reduces the current ripple, at the switching frequency, to the output, item 220.

Item 630 is an isolated power supply for providing the power for the driver integrated circuit, item 622.

Figure 13:
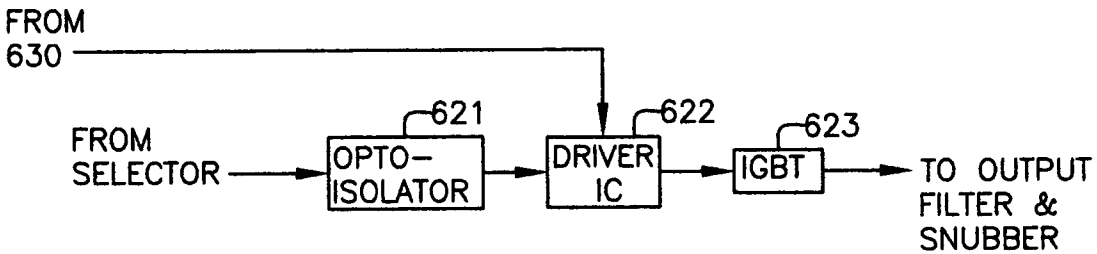
FIG. 13 is block diagram of embodiment 4 and the output drive for the use of pulse width modulation.

Item 620 (See FIG. 13) is the output driver. Item 621 is a high frequency optical isolator (opto-isolator) integrated circuit which has fast response time. The input to the opto-isolator 621 is from the output of the comparator 310 through the output select logic 340. The output of the opto-isolator item 621 is the input of the drive IC (integrated circuit) item 622. Item 622 is provided power by the isolated power supply, item 630. Item 622, then provides the gate drive signal to the transistor 623 to control the turn on and turn off of this transistor in response to the signal from the opto-isolator. Item 623 is preferably an IGBT (Isolated Gate Bipolar Transistor). A MOSFET (Metal Oxide Semiconductor Field Effect Transistor) transistor could also be used. The output from driver item 620 is connected through the output filter item 610 to the output receptacle 230 to power the light 230 that is connected to this receptacle.

Embodiment 5

Figure 11:
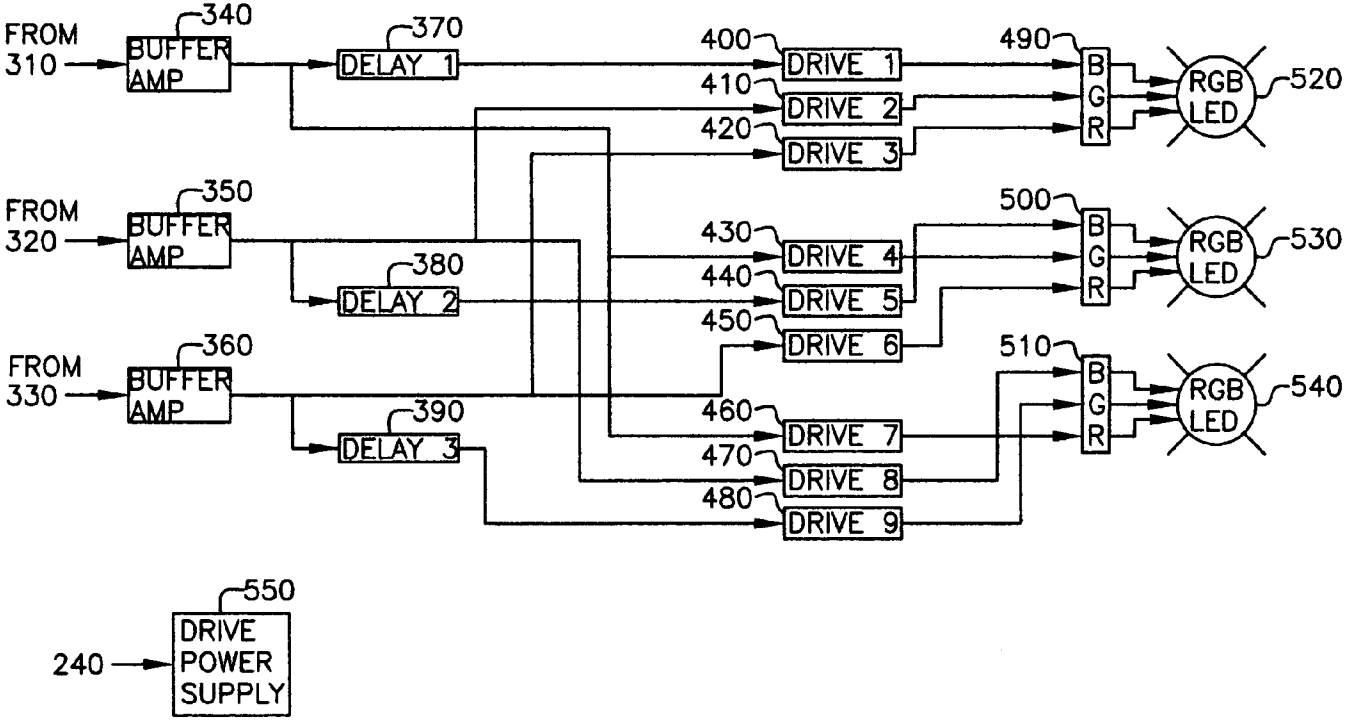
FIG. 11 is a block diagram of output drive for embodiment 5 for driving RGB LED's.

Embodiment 5 (See FIG. 11) has outputs driving RGB (Red, Green, Blue) LED modules. The RGB modules used for R&D are Lamina BL-4000.

Items 340, 350 and 360 are buffer amplifiers. These buffer amplifiers are transistor emitter followers made up of and NPN transistor for pull up and a PNP transistor for pull down with an output resistor to prevent oscillation of the emitter followers.

Figure 14:
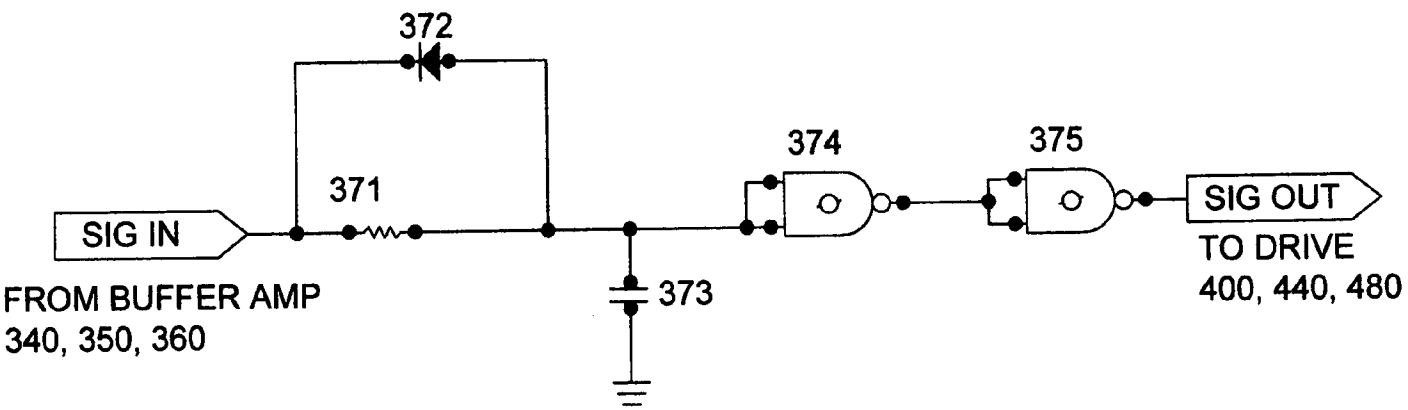
FIG. 14 is a detailed schematic of items 370, 380, & 390, of FIG. 11, RGB drive.

Items 370, 380 and 390 (See FIG. 14) are delay circuits 370, 380, and 390 provide approximately a 1 millisecond delay in the signal to the drive circuit for one element of the drive for each RGB LED. The reason for the delay is that if all three signals to an RGB LED have equal on time then the color white is shown, so these delay circuits, 370, 380 and 390 are white suppression circuits so that the result is that the RGB LED lights 520, 530, and 540 are more colorful in response to the audio signal. The rise of the signal from buffer Amp 340, or 350 or 360 is delayed by the charge of capacitor 373 through resistor 371. When the signal from the buffer amp 340 drops to zero the capacitor 373 is quickly discharged through diode 372. Nand gate 374 is a gate with a Schmidt trigger input so that the signal switching out of nand gate 374 has a sharp rise and fall. Nand gate 374 inverts the signal so nand gate 375 is added to restore the polarity of the signal. The output from nand gate 375 goes to the selected drives 400 or 440 or 480.

Item 550 is a power supply for the output drives 400 through 480. This power supply provides a regulated positive 9 volts dc and a negative 5 volts dc.

Figure 15:
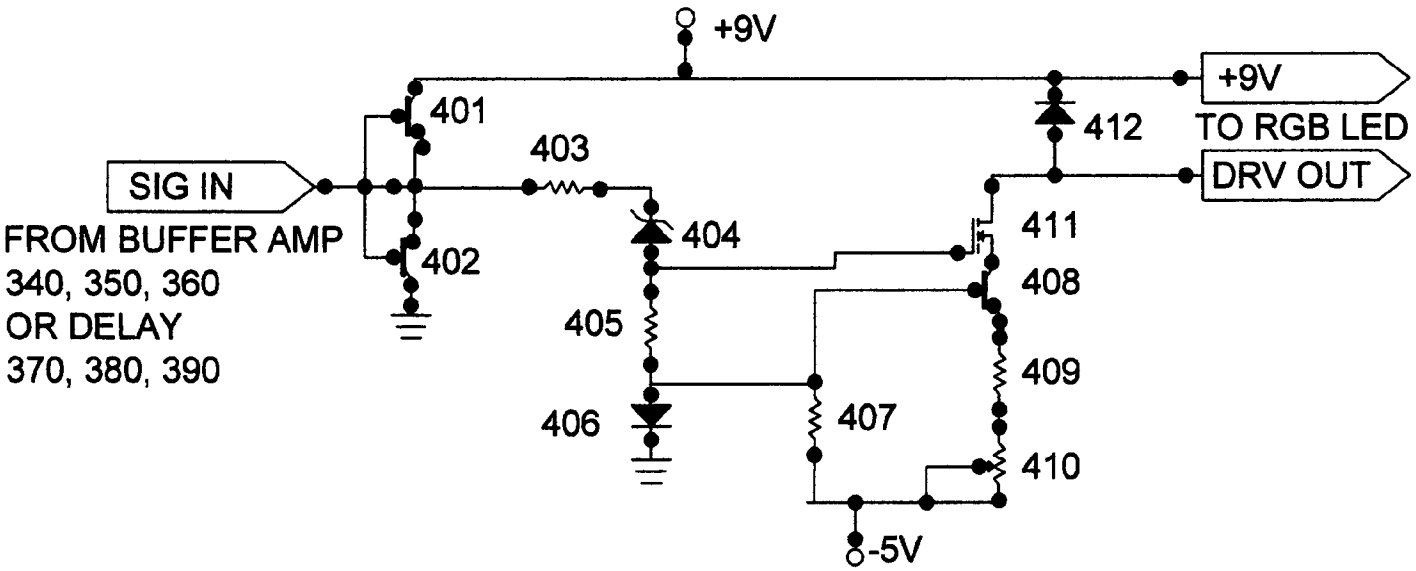
FIG. 15 is a detailed schematic of the output RGB drives 400 through 480 of FIG. 11.

Items 400 through 480 (See FIG. 15) (Item 400 is taken as an example) The signal from the delay circuit 370 is input to the emitter follower transistors 401 and 402. The NPN transistor 401 provides a rapid pull up and the PNP transistor 402 provides a rapid pull down, thus the signal from the emitters through resistor 403 is switched sharply in response to the input signal. Resistor 403 is a small resistor to prevent oscillations of the emitter followers 401 and 402. Zener diode 404 drops the voltage from the output of the emitter followers by 5 volts so that when the output of the emitter followers 401 and 402 is low the MOSFET transistor 411, and the NPN transistor 408 are both biased off. When the input signal is high the signal from the emitter followers through resistor 403 is high the voltage at the gate of MOSFET transistor 411 is raised to turn on transistor 411 on, this voltage will also turn on NPN transistor 408. When transistor 408 turns on it switches 5 volts across resistor 409 and potentiometer 410. Resistor 409 and potentiometer 410 set the current through transistors 408 and 411 and thus the current to the LED element to which they are connected. Diode 406 has approximately the same voltage across it as the emitter base junction of transistor 408, so that the voltage at the base of transistor 408 is at about a plus 0.6 volts. This causes the full 5 volts from the negative 5 volt supply to be applied across resistor 409 and potentiometer 410. The variation in the emitter base junction of transistor 408 with temperature is approximately matched by the variation in voltage with temperature of the voltage of diode 406 so that the current source is stable with temperature changes. Diode 412 provides a path for any reverse voltage that could by generated at the turn off of transistor 411, such a reverse voltage would be created by any inductance in the output leads. This protects the transistor 411 from any excessive voltage transient when it is turned off. Potentiometer 410 provides a means of adjusting the output current of the drive.

Items 490, 500 and 510 are the output connectors for connecting the RGB LED's to the outputs. There are six possible variations in the connection of any of the RGB element. With the delay circuits, 370, 380 and 390 this provides 18 variations in the possible variations in the response of the RGB LED's 520, 530 and 540. Since the selected RGB LED's used Lumina BL-4000 is such that each element uses the same current the RGB LED's could be connected in series will the connections changed, to have more RGB LED's driven with each out. This would provide 6 different colors going at the same time if each output was connected to 2 RGB LED's; or 9 different colors if each output was connected in this manner. Since there are 6 different possible connection configurations for an RGB LED, six variations could be connected to each output, this would provide 18 different colors since by reason of the delay circuits each would be different. Connecting additional RGB LED's in strings would require a higher voltage than the plus 9 volts from the power supply 550, and the transistor 411 would be switching at a higher voltage and thus more power.

Items 520, 530 and 540 are three element RGB LED modules. Lumina BL-4000's are used since they are made with red, green and blue elements can all be operated at the same current levels.

Embodiment 6

Figure 16:
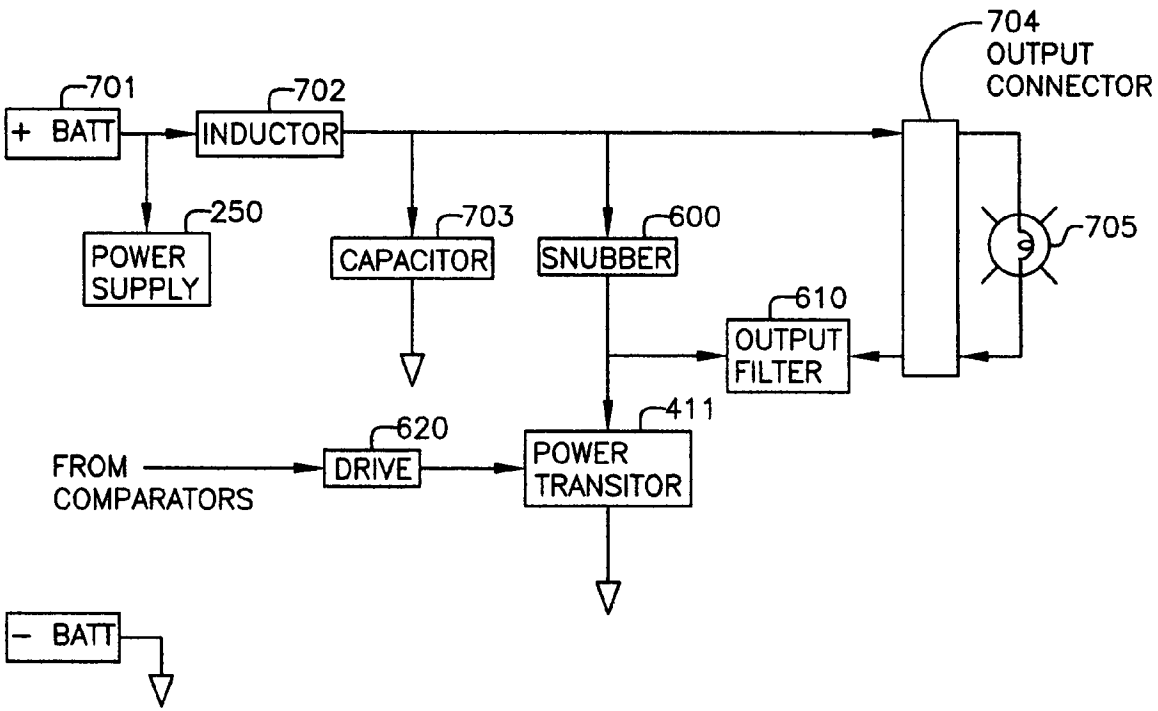
FIG. 16, Embodiment 6 is a block diagram of a change for use in an auto or RV from a 12 volt battery.

Embodiment 6 (See FIG. 16) is for use in an automobile or RV use from a 12 volt dc battery. This can be connected to the 12 volt dc line or the automobile or RV or can be connected to the cigarette lighter output, for low power lights. The output power drive is by PWM as in embodiment 4. Embodiment 6 uses 3 filter bands as in the Preferred Form. Item 250, the power supply differs from the Preferred Form in that there is no transformer in the power supply nor does it produce a sync output. Item 250, produces, output voltages of 8 volts dc, 5 volts dc and the 4 volt reference as in the Preferred Form. Item 180 the ramp generator is not used in Embodiment 6, instead the triangular wave generator item 560 is used, as in Embodiment 4.

Item 701 is the power switch for turning the power on and off.

Item 702 is an inductor, and 703 is a capacitor that form an input filter to keep switching transients, from the switching of transistor 411 from feeding back on the 12 volt dc supply wires.

Item 600 is the snubber as used in Embodiment 4; there is one of these for each of the 3 bands.

Item 610 is the output filter as used in Embodiment 4; there is one for each of the 3 bands.

Item 622 is the integrated circuit driver for driving the gate of the power transistor, 411. The input signal is from the respective comparator output; there are 3 of these, one for each band.

Item 411 is an IGBT power transistor as used in Embodiment 4. A power MOSFET transistor could also be use as transistor 411.

Item 704 is a two terminal jack to which the lights 705 can be connected, one for each band.

Item 705 is a 12 volt dc light or an arrangement of a number of 12 volt dc lights connected in parallel to each of the 3 outlets. This item could also be a string of LED's connected for 12 volt operation; again a number of 12 volt strings of LED's could be connected in parallel to each of the 3 outlets 704.

Embodiment 7

Figure 17:
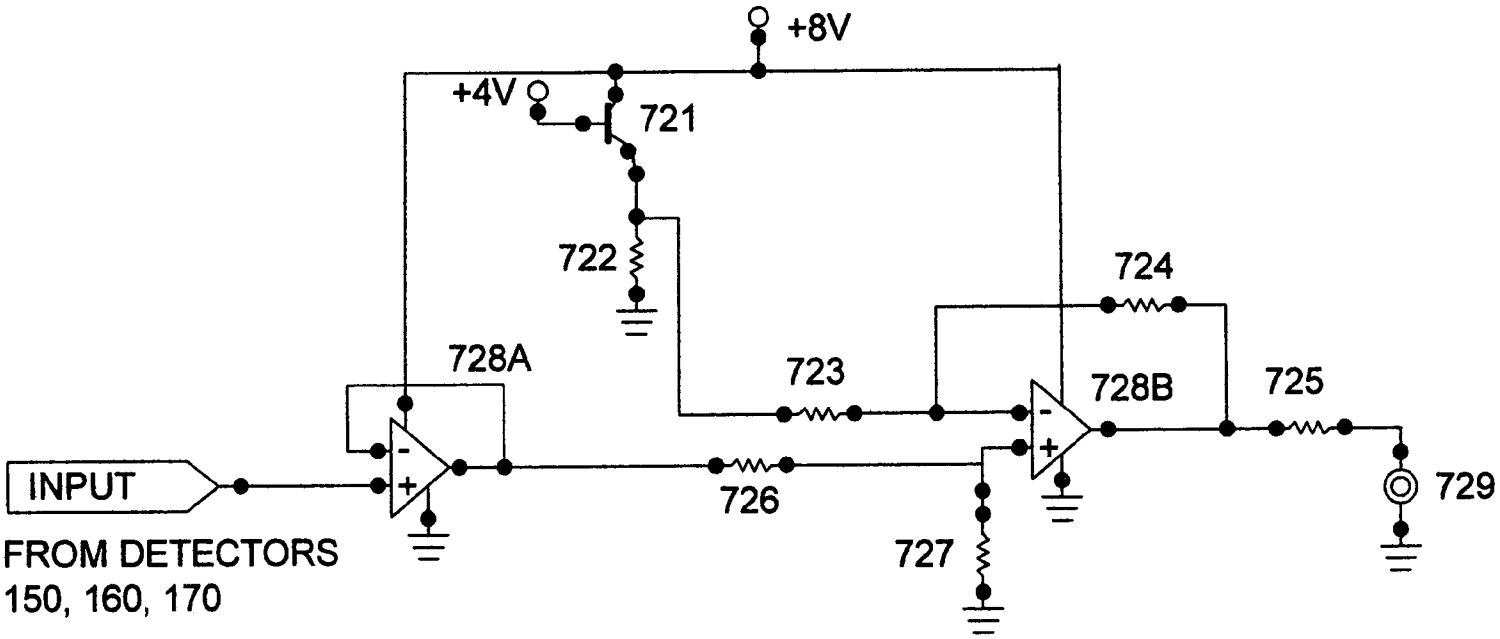
FIG. 17 is a block diagram of embodiment 7 which is used to provide a drive signal such as a modulation signal for lasers. This embodiment does not use the comparators, and output drive, however, this embodiment may be added to any of the previous embodiments.

Embodiment 7 (See FIG. 17) is used to provide a drive signal such as a modulation signal for lasers. This embodiment does not use the comparators, and output drive, however, this embodiment may be added to any of the previous embodiments. There are 3, amplifier arrangements as shown in FIG. 17 for 3 frequency bands as in the Preferred Form. Operation is not limited to 3 bands. Items 728A and 728B are a dual operational amplifier. Item 721 is a PNP transistor that in conjunction with resistor 722 provides a reference voltage that is equal to the zero voltage output of the detectors 150, 160, and 170. Amplifier 728A is connected as a buffer amplifier to avoid loading down the detector circuits. Resistors 723, 724, 726 and 727 are all of equal value. Resistors 723, 724, 726, 727 and amplifier 728B form a differential amplifier that has unity gain. Since transistor 721 and resistor provide a voltage that is equal to the zero output voltage of the detectors the voltage at the output of amplifier 728B will be equal to the output of detectors that is referenced to ground instead of to about 3.5 volts. The resistor 725 is a low value of resistor to prevent capacitive loading by the cable connected to output jack 729 from causing instability of the amplifier 728B. There are output jacks 729 for each band. For embodiment 7 as a variation of embodiments 2, 3, 4 or 5 the base of transistor 721 is connected to ground instead of to +4 volts and the bottom end of resistor 722 is connected to −5 volts, and the plus supply voltage is=5 volts instead of +8 volts.

In the development of the present invention the first problem encountered was that the dynamic range of response of the lights, visual was much smaller than the range of the audio signal. This dictated the need for compressing the audio signal, and the use of AGC to maintain the signal, this problem was solved with the discovery of a commercially available integrated circuit amplifier that met this requirement.

Another problem was that the an audio signal is typically shorter in time (because of the higher frequency of audio in relation to visual.) than the needed visual response; this problem was solved by use of a detector which captures the crest of the audio signal and stretches it so that it can be readily displayed. This response time was made selectable, by the operator, for a sharp or soft appearance of the lights.

Another problem was to have the output voltage to the lights have a linear response to the detected and stretched signal. This was achieved by creating a firing circuit for the output triacs that had a linear output voltage in relation to the signal. This is done by creating a ramp voltage that is synchronized with the zero crossings of the ac line voltage, then this ramp is compared with voltage comparators to the signal from the detector circuits. This is done in such a way the when the detector output voltage is low the triacs (SCR's could be used.) are turned on late in the ac voltage cycle to produce a correspondingly low output voltage, and when the detector output voltage is high the triacs are fired earlier in the ac voltage cycle. There is a slight deviation from linearity between the voltage from the detector output and the output voltage.

Another problem in the Embodiment 2 was how to easily vary the positions of the filter bands in frequency that is to keep the width of the midrange band while moving it in frequency that is to keep the width of the band at approximately an octave, but have the band at a different frequency. This problem was solved by using switched capacitor filters, which make use of a clock to set the frequency, the clock frequency setting was then made available to the operator.

This invention provides the lights connected to it a much improved response to the audio signals such as music. Triacs are used as the output device. Triacs can be controlled to conduct on both halves of the ac line. Thus the firing of the triacs is done at a 120 hertz rate, once during each half cycle of the ac line power. By controlling the timing of the firing of the output triacs in a more precise manner than previously used circuits and controlling the firing precisely for each half cycle this invention provides an improved response of the output voltage. Thus the lights show an improved response to audio signals such as music. The result of using the ramp and comparator is to have the output voltage be proportional to the audio signal from the detector, and a response of the lights to follow the audio in an improved manner; such as variations is loudness. Tests of the output voltage and power to the lights as the signal level was changed showed a nearly linear change of voltage and power as the signal level was changed. (The power in incandescent lights is nearly linear with voltage applied because of the resistance increasing with the heating of the filament.)

We claim:

1. A method of controlling a source of light in accordance with variations in a source of sound comprising:

providing a pulse of electricity which has a first voltage with a waveform that rises in a shorter time than it falls, and providing a second voltage modulated by the sound from said source of sound and which causes current to flow and control said source of light when said second voltage is higher than the said first voltage, wherein said step of providing a second voltage (including) providing said current with variations, and compressing at least a part of said variations in said current before the current controls said source of light and said controls said source of lighting providing detectors and a linear firing circuit so that a brightness of said source of light will vary in direct proportion to the variation of said compressed current.

2. The method of controlling a source of light in accordance with variations in a source of sound as defined in claim 1 comprising:

said step of providing a waveform includes providing a waveshape, a portion of which is linear.

3. Apparatus for controlling a source of light in accordance with variations in a source of sound, comprising:

a first electrical circuit which has a first voltage in form of a pulse that has a waveform that rises in a shorter time than it falls, a second electrical circuit which is modulated by sound from said source of sound;

an electrical system that controls said source of light by a second voltage when said second voltage is higher than the first voltage;

means for compressing current variations in said second electrical circuit, said compression occurring after the second electric circuit has been modulated and prior to the current reaching said electrical system; and means, including a least a detector and a linear firing circuit, for controlling brightness of said source of light and cause said brightness to vary in direct proportion to the variation of said compressed circuit.

4. The apparatus for controlling a source of light in accordance with variations in a source of sound as defined in claim 3 wherein:

a portion of said waveform is linear.

5. Apparatus for controlling a source of light in accordance with variations in a source of sound, comprising:

means for converting said source of sound into an electrical current that has a varying voltage which is modulate by said source of sound, means for compressing at least a portion of said varying voltage, and means for controlling said source of light to vary brightness of said light in direct proportion to the variations of said compressed voltage, wherein said means for controlling said source of light includes transistorized outputs, with pulse width modulation, to provide a near unity input power factor so that the brightness of the lights will vary directly in proportion to the variations in said compressed voltage.

6. The apparatus for controlling a source of light in accordance with variations in a source of sound as defined in claim 5, in which said means for controlling said source of light includes a linear firing circuit so that the brightness of the lights will vary directly in proportion to the variations in said compressed voltage.

7. The apparatus for controlling a source of light in accordance with variations in a source of sound as defined in claim 5, wherein said means for controlling said controlling said source of light includes a triangular wave generator.

8. The apparatus for controlling a source of light in accordance with variations in a source of sound as defined in claim

5, wherein said means for controlling said source of light includes a triangular-pulse generator producing a pulse with a saw-tooth waveform.

* * * * *